US007165545B1

(12) United States Patent
Shiue

(10) Patent No.: US 7,165,545 B1
(45) Date of Patent: Jan. 23, 2007

(54) SPLASH PROTECTION DEVICE FOR SNORKEL

(75) Inventor: Chih-Cheng Shiue, Escondido, CA (US)

(73) Assignee: QDS Injection Molding LLC, Escondido, CA (US)

( * ) Notice: Subject to any disclaimer, the term of this patent is extended or adjusted under 35 U.S.C. 154(b) by 0 days.

(21) Appl. No.: 11/373,973

(22) Filed: Mar. 14, 2006

(51) Int. Cl.
*A63C 11/16* (2006.01)
*A63C 11/02* (2006.01)

(52) U.S. Cl. ..... 128/201.11; 128/201.27

(58) Field of Classification Search ..... 128/201.11, 128/200.29, 201.26, 201.27, 201.28, 202.14, 128/206.26; 405/185, 186, 187
See application file for complete search history.

(56) References Cited

U.S. PATENT DOCUMENTS 2,815,751 A * 12/1957 Ferraro ..... 137/410
3,166,083 A * 1/1965 Girden ..... 137/388
5,267,556 A * 12/1993 Feng ..... 128/201.11
5,960,791 A * 10/1999 Winefordner et al. . 128/201.11
6,085,744 A * 7/2000 Hermansen et al. ... 128/201.11
6,129,081 A * 10/2000 Wu ..... 128/201.11
6,679,253 B1 * 1/2004 Feng ..... 128/201.11
6,843,246 B2 * 1/2005 Shiue ..... 128/201.11
6,994,085 B2 * 2/2006 Shiue ..... 128/201.11
2004/0226557 A1 * 11/2004 Shiue ..... 128/201.11

* cited by examiner

*Primary Examiner*—Teena Mitchell
(74) *Attorney, Agent, or Firm*—Troxell Law Office, PLLC

(57) ABSTRACT

A splash protector mounted at top of snorkel is disclosed and includes a tube-shaped adapter unit secured to the snorkel and including a passage; a float unit pivotably secured to the adapter unit and including a projected lever and two upper engagement members (e.g., tabs) at two sides of the lever; a closure unit pivotably secured to the adapter unit and including two mating engagement members (e.g., indents) at both sides, and a closure member adapted to close the passage when the lever pivots upward; and a splash guard secured to the adapter unit for receiving both the float and closure units and including windows for fluid communication. The engagement members are adapted to lockingly engage with the mating engagement members for stopping the closure unit from further pivoting upward and thus preventing the passage from being closed by the closure member undesirably.

5 Claims, 3 Drawing Sheets

SPLASH PROTECTION DEVICE FOR SNORKEL

BACKGROUND OF THE INVENTION

1. Field of Invention

The present invention relates to splash protection attachment mounted on a snorkel for deep diving, surface diving or other water activities and more particularly to an improved splash protector mounted on an upper opening of a snorkel tube and served as a valve.

2. Related Art

Snorkels are ubiquitous tools for divers engaging in deep diving, surface diving or the like. A snorkel is designed as a breathing tube used in swimming under water or at the surface of water. The snorkel has an upper opening adapted to extend beyond the surface of water for air communication. The opening is closed automatically when the snorkel is submerged so as to prevent water from entering the snorkel tube. Otherwise, water may be inhaled into the mouth and lungs causing choke.

A wide variety of attachments as splash protectors each mounted on an upper opening of snorkel are available. Typically, such splash protector includes a float member adapted to close an air passage of the snorkel by virtue of its buoyancy when a snorkeler is submerged. A patent relevant to the invention is U.S. Pat. No. 5,960,791 as shown in FIGS. 1 and 2. The disclosed dry snorkel comprises a float member A, a closure member B, a passage C, and a splash guard D as indicated by dotted lines. The patent is advantageous over other prior dry snorkels. However, the patent still suffered from a couple of disadvantages. For example, a snorkeler may move to incline the snorkel tube prior to submerging (see FIG. 2). This may cause the closure member B at an upper end of the float member A to block the passage C, resulting in the prohibition of snorkeler inhaling. Further, a strong suction is generated when a snorkeler quickly inhales a great amount of air even in a normal operating angle of the snorkel tube. As such, the closure member B is sucked to close the passage C, thereby stopping the air passage C. Thus, continuing improvements in the exploitation of splash protection device for snorkel are constantly being sought.

SUMMARY OF THE INVENTION

It is therefore an object of the present invention to provide a splash protection device mounted at a top of a snorkel, comprising a tube-shaped adapter unit mounted at the top of the snorkel including an axial passage secured to the snorkel and being in fluid communication therewith; a float unit pivotably secured to the adapter unit and adapted to pivot upward or downward by virtue of its buoyancy or not, the float unit including an upper projected lever; a closure unit pivotably secured to the adapter unit and including an upper closure member adapted to close the passage when the lever (i.e., the float unit) pivots upward; and a splash guard secured to the adapter unit for receiving both the float and closure units, the splash guard including a plurality of windows for fluid communication.

In one aspect of the present invention the closure unit pivots upward by means of and together with the lever until the passage is closed by the closure member.

In another aspect of the present invention the closure member is prevented from closing the passage due to quick inhaling of a snorkeler.

In a further aspect of the present invention the closure member is prevented from closing the passage due to the snorkel in an inclined position.

The above and other objects, features and advantages of the present invention will become apparent from the following detailed description taken with the accompanying drawings.

DETAILED DESCRIPTION OF THE INVENTION

Figure 1:
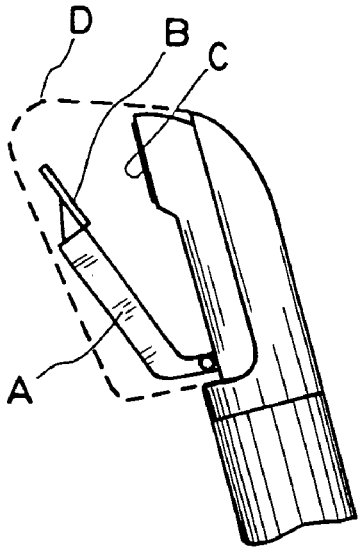
FIG. 1 (PRIOR ART)
FIG. 1 is a side elevational view of a conventional dry snorkel having an adapter assembly as splash protector mounted at an upper end of the snorkel tube where a passage is open when top of the snorkel exits the water.
Figure 2:
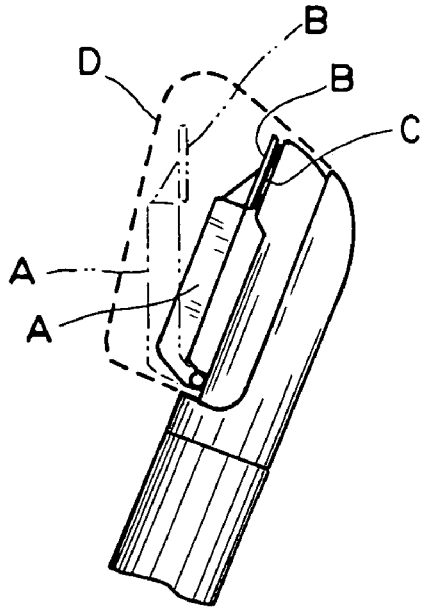
FIG. 2 (PRIOR ART)
FIG. 2 is a view similar to FIG. 1 where the passage is closed due to the inclined snorkel tube.
Figure 3:
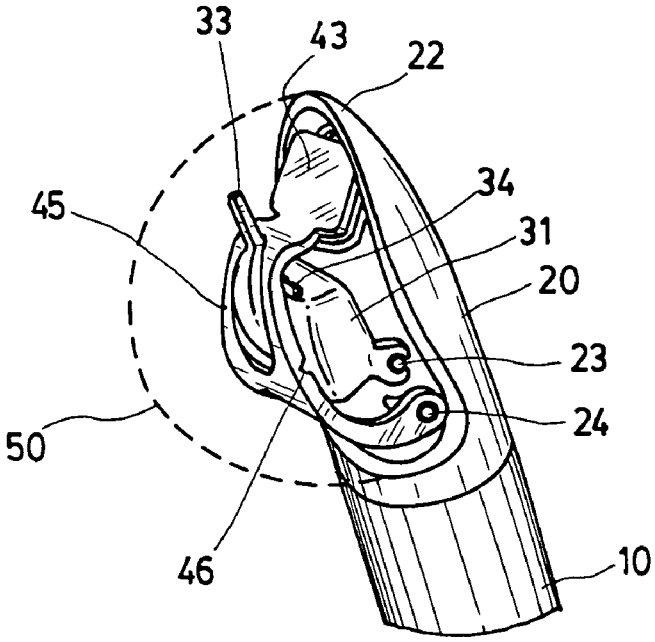
FIG. 3 is a perspective view of upper portion of a preferred embodiment of snorkel incorporating a splash protector according to the invention.
Figure 4:
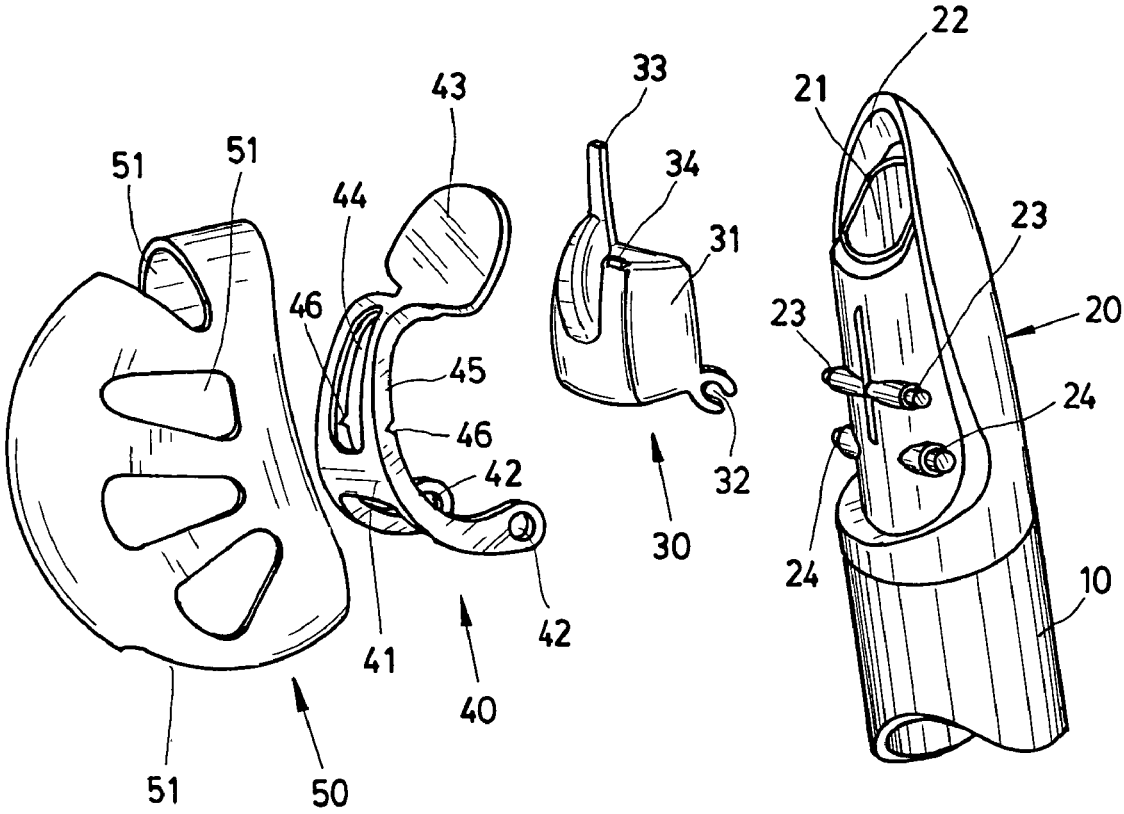
FIG. 4 is an exploded view of FIG. 3.

Referring to FIGS. 3 and 4, a snorkel 10 incorporating a splash protector at its top in accordance with a preferred embodiment of the invention. The splash protector comprises an adapter unit 20, a float unit 30, a closure unit 40, and a splash guard 50. Each component is discussed in detailed below.

The elongate, tube-shaped adapter unit 20 comprises an axial passage 21 secured to the snorkel 10 and being in fluid communication therewith, a wall 22 partially encompassed the passage 21 for decreasing splash entering the passage 21, two intermediate, opposite first pins 23 projected from an outer surface of the adapter unit 20, and two lower, opposite second pins 24.

The float unit 30 is formed of a material having a specific weight less than water and comprises a body 31, an upper projected lever 33, two lower, opposite recesses 32 rotatably engaged the first pins 23 thereby securing the float unit 30 to the adapter unit 20, and two upper tabs 34 at two sides of a joining portion of the lever 33 and the body 31.

The arcuate closure unit 40 comprises a body 41, two lower, opposite holes 42 rotatably engaged the second pins 24 thereby securing the closure unit 40 to the adapter unit 20, an upper plate-shaped closure member 43 adapted to close the passage 21 or not, two elongate openings 44 with the lever 33 projected through the upper one of the openings 44, two side braces 45, and two indents 46 on the braces 45. Note that the closure member 43 may be shaped other than plate as long as it is capable of closing the passage 21.

The bowl-shaped splash guard 50 is a well known device and comprises a plurality of windows 51 for fluid communication and is secured to the adapter unit 20. A sufficient space is thus formed in the splash guard 50 for receiving both the float and closure units 30 and 40 and protecting same.

Figure 5:
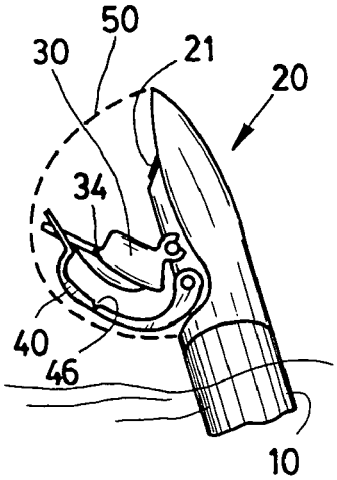
FIGS. 5, 6, and 7 are perspective views showing the invention at the surface of water in a normal position, at the surface of water in an inclined position, and under the surface of water when the snorkeler is submerged respectively.
Figure 6:
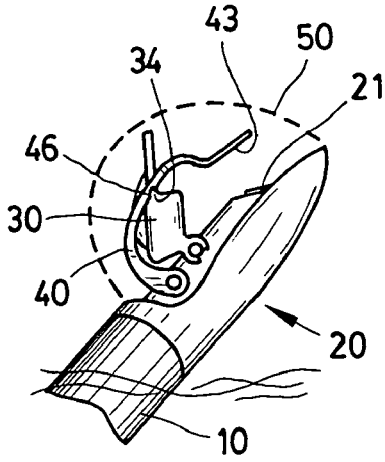
Figure 7:
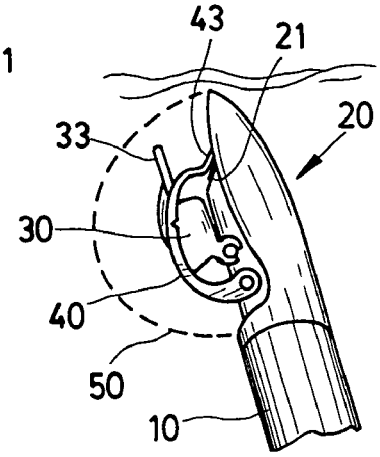

Referring to FIGS. 5, 6, and 7, an operation of the invention will be described in detailed below. In FIG. 5, a snorkeler is at the surface of water in a normal position with the adapter unit 20 at the top of the snorkel 10 disposed above the water level, the float unit 30 being not floated, and the closure unit 40 being at a maximum angle relative to the adapter unit 20. In brief, the passage 21 is open and the snorkeler is able to inhale freely through the passage 21.

In FIG. 6, the snorkel 10 is at the surface of water in an inclined position. Also, float unit 30 is not floated, the closure unit 40 pivots upward due to the inclined position of the snorkel 10. The pivoting is stopped by the float unit 30 when the tabs 34 enter the indents 46 and are lockingly engaged therewith. At this position, the passage 21 is still open.

In FIG. 7, the snorkel 10 is under the surface of water when the snorkeler is fully submerged. The float unit 30 pivots upward by virtue of its buoyancy. And in turn, the closure unit 40 pivots upward by means of and together with the lever 33 until the passage 21 is closed by the closure member 43.

While the invention herein disclosed has been described by means of specific embodiments, numerous modifications and variations could be made thereto by those skilled in the art without departing from the scope and spirit of the invention set forth in the claims.

What is claimed is:

1. A slash protection device mounted at a top of a snorkel, comprising:

a tube-shaped adapter unit mounted at the top of the snorkel including an axial passage secured to the snorkel and being in fluid communication therewith;

a float unit formed of a material having a specific weight less than water, the float unit being pivotably secured to the adapter unit and adapted to pivot upward or downward by virtue of its buoyancy or not, the float unit including an upper projected lever;

a closure unit pivotably secured to the adapter unit and including an upper closure member adapted to close the passage when the lever pivots upward; and a bowl-shaped splash guard secured to the adapter unit and including a space for receiving both the float and closure units, and a plurality of windows for fluid communication, wherein the adapter unit further comprises two intermediate, opposite first pins projected from an outer surface of the adapter unit pivotably secured to the float unit, and two lower, opposite second pins projected from the outer surface of the adapter unit pivotably secured to the closure unit.

2. The splash protection device of claim 1, wherein the closure unit further comprises at least one opening for permitting the lever to project therethrough.

3. A splash protection device mounted at a top of a snorkel, comprising:

a tube-shaped adapter unit mounted at the top of the snorkel including an axial passage secured to the snorkel and being in fluid communication therewith;

a float unit formed of a material having a specific weight less than water, the float unit being pivotably secured to the adapter unit and adapted to pivot upward or downward by virtue of its buoyancy or not, the float unit including an upper projected lever;

a closure unit pivotably secured to the adapter unit and including an upper closure member adapted to close the passage when the lever pivots upward; and a bowl-shaped splash guard secured to the adapter unit and including a space for receiving both the float and closure units, and a plurality of windows for fluid communication, wherein the closure unit further comprises two mating engagement members at both sides, and the float unit further comprises two upper engagement members at two sides of a lower portion of the lever, the engagement members being adapted to lockingly engage with the mating engagement members for stopping the closure unit from further pivoting upward.

4. The splash protection device of claim 3, wherein the mating engagement members are indents and the engagement members are tabs.

5. The splash protection device of claim 3, wherein the mating engagement members are tabs and the engagement members are indents.

* * * * *